United States Patent [19]

Stoecker

[11] 4,057,248

[45] Nov. 8, 1977

[54] BASEBALL PRACTICE DEVICE

[76] Inventor: William J. Stoecker, 14606 S. Hamlin, Midlothian, Ill. 60445

[21] Appl. No.: 646,603

[22] Filed: Jan. 5, 1976

[51] Int. Cl.[2] ..... A63B 69/40

[52] U.S. Cl. ..... 273/26 R

[58] Field of Search ..... 273/26 R, 25, 95 A; 119/120

[56] References Cited

U.S. PATENT DOCUMENTS

| | | | |
|---|---|---|---|
| 3,105,682 | 10/1963 | Ahrens | 273/95 A |
| 3,558,134 | 1/1971 | Hoitsman | 273/26 EA |
| 3,874,662 | 4/1975 | Harrington | 273/26 E |

*Primary Examiner*—Richard C. Pinkham
*Assistant Examiner*—T. Brown

[57] ABSTRACT

A baseball practice device comprises a pair of ground-engaging panels connected by calibrated cord means which, when taut, marks a predetermined distance between said panels. Each panel has a surface defining a home plate and an edge portion defining a pitcher's plate. The panels enable cooperative alternate pitching and catching practice by two players each stationed at an associated panel.

6 Claims, 5 Drawing Figures

Fig. 2.
36
39
37
16
14
12
11
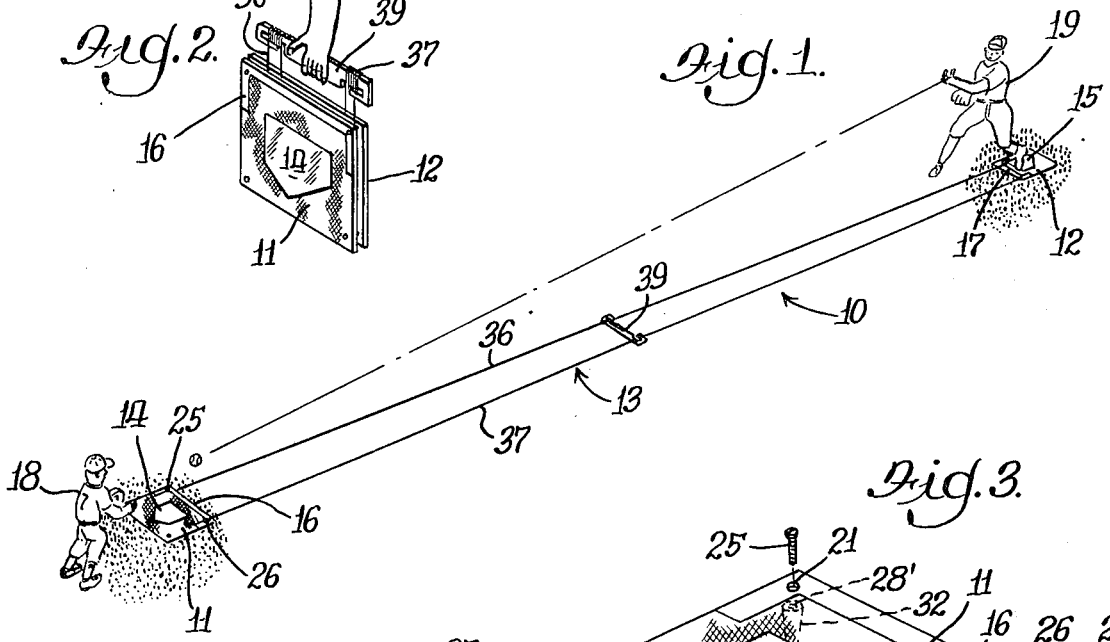
Fig. 1.
19
15
17
12
39
10
36
13
37
14
25
18
16
26
11
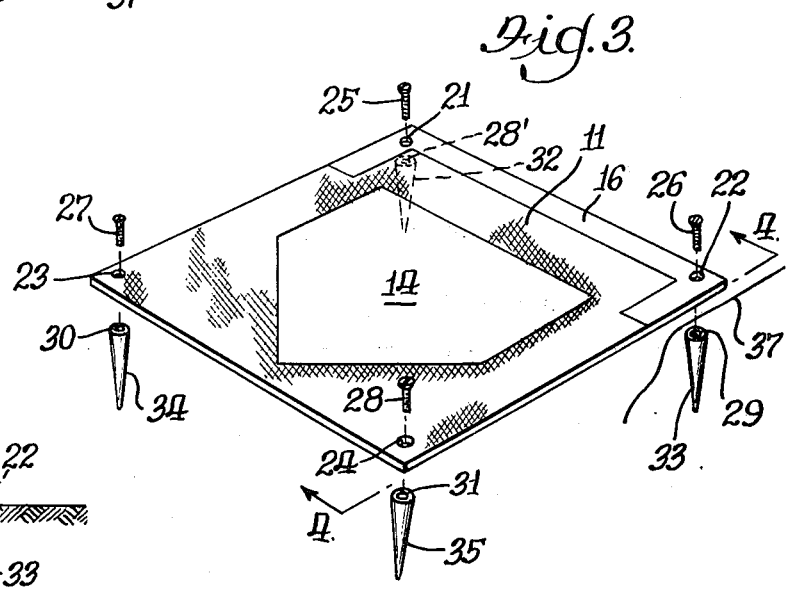
Fig. 3.
25
21
28'
32
11
16
26
22
27
4
23
14
30
37
34
28
29
33
24
31
4
35
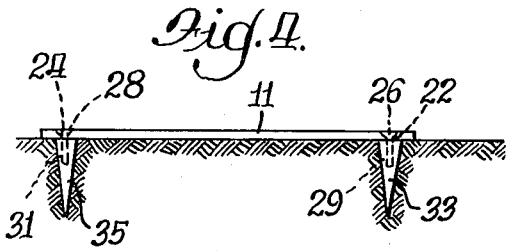
Fig. 4.
24
28
11
26
22
31
35
29
33
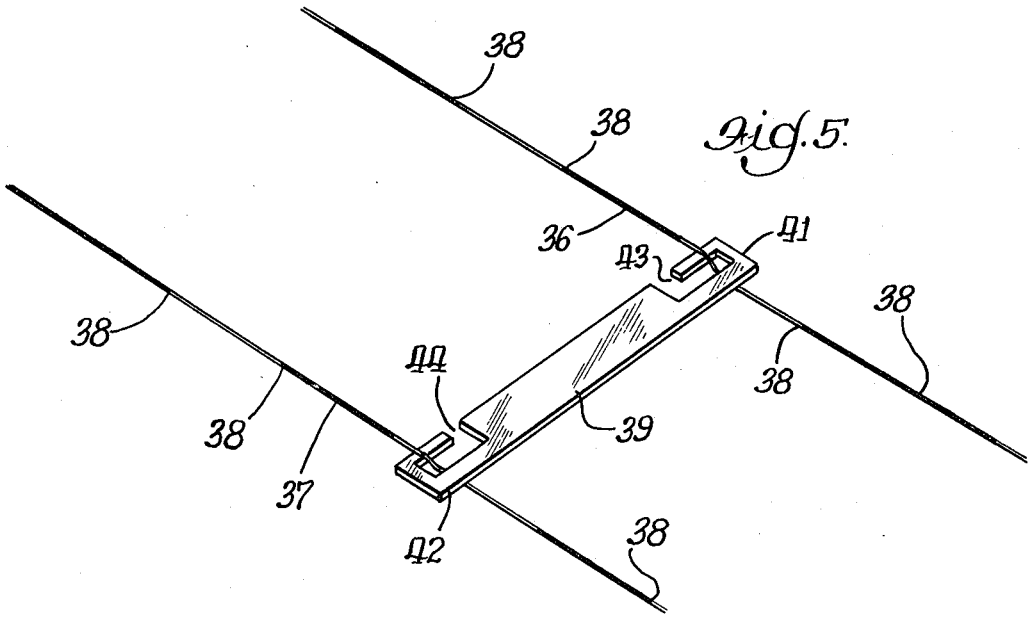
Fig. 5.
38
38
36
41
43
38
38
38
44
39
38
37
42
38

BASEBALL PRACTICE DEVICE

BACKGROUND OF THE INVENTION

This invention relates in general to sport practicing devices, and, more particularly, to practice devices which enable baseball players to develop and improve pitching and catching skills.

DESCRIPTION OF THE PRIOR ART

In non-professional baseball, there are generally few practice devices available to players to develop their pitching and catching skills. For example, little league, neighborhood and other amateur teams typically play baseball in parks and lots which have no auxiliary plates for use by team members during practice or warm-up.

SUMMARY OF THE INVENTION

The present invention is a simple and inexpensive solution to this problem, and generally comprises a portable baseball practice device comprising a pair of ground-engaging panels connected by calibrated cord means which, when taut, marks a predetermined distance between the panels. Each panel has a surface defining a home plate and an edge portion defining a pitcher's plate or rubber. The panels enable cooperative alternate pitching and catching practice by two players each stationed at an associated panel. The panels preferably include downwardly extending spikes for secure ground engagement, thereby preventing panel movement when a practicing player steps off of the panel during pitch delivery.

BRIEF DESCRIPTION OF THE DRAWINGS

FIG. 1 illustrates the use of the preferred embodiment of the baseball practice device of the present invention;

FIG. 2 is a perspective view showing the component parts of the preferred embodiment of FIG. 1 arranged for carrying or storage, the panels being disposed in back-to-back arrangement and their connecting cord being wound for storage;

FIG. 3 is a top perspective view showing the details of one of the panels illustrated in FIG. 1;

FIG. 4 is a side elevational view taken substantially along the line 4—4 of FIG. 3 and illustrating the ground-engaging spikes for securing the panel to the ground; and FIG. 5 illustrates the use of a center board for winding the cord connecting the panels.

DESCRIPTION OF THE PREFERRED EMBODIMENT

With particular reference to FIG. 1, the present invention comprises a baseball practice device, generally indicated by reference numeral 10, comprising a pair of ground-engaging panels 11, 12 and calibrated cord means 13 for directly connecting the panels. When the cord means 13 is taut, it marks a predetermined distance between the panels 11, 12 representing the distance between the pitcher's plate and home plate in accordance with the applicable baseball rules.

Marked or otherwise formed on panels 11, 12 respectively are; surfaces 14, 15 defining home plates, and perimetal or inner edge portions 16, 17 representing the outline of pitcher's plates or rubbers. The panels 11, 12 enable cooperative alternate pitching and catching practice between players 18, 19, respectively, stationed at the panels. As seen in FIG. 1, player 19 steps off of the inner edge portion 17 of panel 12 to deliver a pitch over the home plate surface 14 of panel 11 to be caught by player 18. The roles of the players 18, 19 are then reversed, and the players thus receive equal pitching and catching practice. It will be understood that an additional player (not shown) acting as a batter can be stationed at one of the panels 11, 12 to receive batting practice.

With reference to FIG. 2, the panels 11, 12 are conveniently disposed in back-to-back relationship for compact storage, with the connecting cord means 13 being wound around a center board, which also serves as a carrying handle, to be described in detail later.

Since the panels 11, 12 are identical, only panel 11 will be described in detail. As seen in FIG. 3, panel 11 preferably comprises a square sheet of weather-resistant rubber or plastic having a home plate polygon suitably marked or painted on surface 14 thereof; edge portion 16 is similarly marked on surface 14. Holes 21, 22, 23 and 24 are provided at the four corners of panel 11 for associated screws 25, 26, 27 and 28 which are received in holes 28', 29, 30 and 31 in downwardly extending spikes 32, 33, 34 and 35, respectively, for securing the spikes to the panel 11, as best seen in FIG. 4.

With further reference to FIG. 1, cord means 13 preferably comprises two opposing calibrated cords, 36, 37 of equal length connected at corresponding corners of panels 11, 12 at their facing edges. The cords 36, 37 are calibrated by suitable markings 38; for example, marks of one color are preferably placed at 1 ft. intervals, with marks of another color indicating 10 ft. intervals. As best seen in FIG. 3, upon measurement of the proper length of typical cord 37, this cord is placed between the bottom of panel 11 and the upper surface of spike 33 so that secure attachment to panel 11 is achieved upon tightening screw 26 into hole 29. The other cord ends are secured in similar fashion.

With reference to FIG. 5, a center board 39 made of weather-resistant material is provided to enable convenient winding of cords 36, 37 into their storage position shown in FIG. 2. Center board 39 comprises a rectangular sheet substantially equal in length to an edge of one of the square panels 11, 12. The center board 39 further comprises apertures 41, 42 at its ends for receiving the cords 36, 37 through outlet openings 43, 44, respectively, which communicate with the apertures. Upon twisting the center board 39, cords 36, 37 will be wound around its surface, and the center portion of the center board can then be used as a convenient handle, as shown in FIG. 2. During carrying and storage, the panels 11, 12 are preferably arranged in back-to-back engagement such that their spikes face inwardly to prevent accidental injury. The spikes are readily removable, however, for even more compact storage of the baseball practice device upon disassembly at the end of each baseball season.

By way of modification, the removable spikes 32, 33, 34 and 35 can be formed integral with plate 11, such as by molding, for example (not shown). With similar size spikes also formed integrally with plate 12, the plates 11, 12 can be nestably stored, i.e., the bottom surface and spikes of one plate placed adjacent the top surface of the other plate. Furthermore, with such a modification, the cords 36, 37 can be tied and knotted at their respective ends or calibrated positions through holes (not shown) appropriately formed in the respective plates. By way of further modification, it will be readily understood that the respective portions of panel 11 that define the pitcher's rubber and home plate, i.e., edge portion 16 and surface 14 respectively, can be formed as separate members flexibly interconnected by suitable fastener means, such as chains or links, for example.

It is thought that the invention and many of its attendant advantages will be understood from the foregoing description, and it is apparent that various changes may be made in the form, construction and arrangement of its component parts without departing from the spirit and scope of the invention or sacrificing all of its material advantages, the form described being merely a preferred embodiment thereof.

The embodiments of the invention in which an exclusive property or privilege is claimed are defined as follows:

1. A baseball practice device comprising a pair of ground-engaging panels and calibrated cord means directly connecting said panels at ground level in opposed spaced relation; said cord means, when taut, marking a predetermined distance between said panels, said predetermined distance being the conventional distance measured between home plate and the pitcher's mound of conventional softball or baseball, each said panel having an unobstructed upper surface for being engaged by a practicing operator's foot, and further characterized as comprising a home plate portion and a pitcher's plate portion; whereby said connected panels enable cooperative alternate pitching and catching practice by associated players stationed thereat.

2. The practice device of claim 1, wherein each said panel is a square sheet and said upper surface has a home plate polygon marked centrally thereon and the outline of a pitcher's plate marked along part of the perimetal edge thereof.

3. The practice device of claim 2, wherein said cord means comprises at least a pair of horizontally spaced cords of equal length connected at facing edges of said panels at corresponding corners thereof.

4. The practice device of claim 3, and a plurality of downwardly extending spikes disposed on each said panel for secure ground engagement, and screw means detachably securing said spikes to their associated said panels, and wherein each end of each said cord is secured between a said spike and a said panel upon tightening an associated said screw means.

5. The practice device of claim 3, and a center board extending between said cords and having an aperture at each end thereof for receiving a cord to enable winding thereof around said board.

6. The practice device of claim 1, and wherein each said ground engaging panel is further characterized as having said home plate portion and said pitcher's plate portion formed as separate members flexibly interconnected by fastener means.

* * * * *